United States Patent [19]

Nishio

[11] Patent Number: 5,019,457

[45] Date of Patent: May 28, 1991

[54] CONDUCTOR USED AS A FUSE

[75] Inventor: Masanobu Nishio, Osaka, Japan

[73] Assignee: Sumitomo Electric Industries, Ltd., Osaka, Japan

[21] Appl. No.: 477,132

[22] Filed: Feb. 7, 1990

Related U.S. Application Data

[63] Continuation of Ser. No. 281,838, Dec. 8, 1988, abandoned.

[30] Foreign Application Priority Data

Oct. 13, 1988 [JP] Japan ..... 63-258050
Nov. 24, 1988 [JP] Japan ..... 63-296881

[51] Int. Cl.[5] ..... C22C 11/00; H01B 1/02; H01H 85/06

[52] U.S. Cl. ..... 428/606; 420/566

[58] Field of Search ..... 420/566; 428/606

[56] References Cited

U.S. PATENT DOCUMENTS

| | | | |
|---|---|---|---|
| 2,299,711 | 10/1942 | Gillett | 420/566 |
| 2,341,865 | 2/1944 | Hermann | 420/566 |
| 2,372,745 | 4/1945 | Smith, Jr. | 420/566 |
| 2,506,348 | 5/1950 | Davis | 420/566 |
| 2,602,775 | 8/1952 | Isherwood | 420/566 |
| 2,993,785 | 7/1961 | Borchers et al. | 420/566 |
| 3,147,114 | 9/1964 | Hack et al. | 420/566 |
| 4,797,328 | 1/1989 | Boehm et al. | 420/566 |

FOREIGN PATENT DOCUMENTS

| | | | |
|---|---|---|---|
| 18505 | 2/1980 | Japan | 420/566 |
| 63-262438 | 10/1988 | Japan . | |
| 63-266034 | 11/1988 | Japan . | |
| 63-266035 | 11/1988 | Japan . | |
| 63-270437 | 11/1988 | Japan . | |

OTHER PUBLICATIONS

Metal Manual, p. 1007, fourth edition, issued Dec. 20, 1982.

*Primary Examiner*—R. Dean
*Assistant Examiner*—David W. Schumaker
*Attorney, Agent, or Firm*—W. G. Fasse; D. H. Kane, Jr.

[57] ABSTRACT

A conductor for a fuse has a main composition of a Pb-Ag alloy containing silver of 0.5 to 20 wt. % and lead and unavoidable impurity for the rest. A conductor for a fuse in another example includes a Pb-Ag-Cu or-/and Te alloy obtained by adding copper or/and tellurium of 0.05 to 1 wt. %, respectively, to the above mentioned Pb-Ag alloy. Each of those conductors for fuses has a diameter in the range from 0.05 to 0.3 mm and it is used as a fuse contained in a capacitor of a tantalum chip for example. Those conductors for fuses have excellent pre-arcing time/current characteristics and good drawability.

4 Claims, No Drawings

CONDUCTOR USED AS A FUSE

This application is a continuation of application Ser. No. 07/281,838 filed Dec. 8, 1988 now abandoned.

BACKGROUND OF THE INVENTION

1. Field of the Invention

The present invention relates to a conductor used as fuse which functions to instantaneously open a related circuit when an overcurrent exceeding a rated current flows, and particularly to a conductor to be used as fuse which is incorporated in a semiconductor device such as an IC or a transistor, or in a circuit component such as a capacitor. The present fuse conductor functions to prevent burning of the device or the component by opening the circuit of the device or the component when an overcurrent flows therein or when it is overheated.

2. Background Information

Conventionally, a metal such as Pb or Zn, or a Pb-Sn alloy is normally used as a fuse as mentioned in "Metal Manual (fourth edition issued Dec. 20, 1982, p. 1007)" edited by the Japan Institute of Metals. The fuse conductor formed of such metal or alloy is melted by Joule heat caused by an overcurrent, thereby to open an electric circuit. If it is desired to accurately set a "fusing" current independently of an outside air temperature, a conductor for a fuse formed of a tungsten wire is sometimes used. A Wood's metal melting at a low temperature is utilized as a fuse of a type melting by overheat in a heating atmosphere.

However, if it is desired to use any of such fuse conductors to add a circuit breaker function to a semiconductor device or a circuit component, it is difficult to draw the conductor to a fine wire or an extra fine wire which can be used. Consequently, under such circumstances, another device having a circuit breaker function is incorporated in a circuit of an electronic apparatus including. If such a fuse conductor itself is directly used, it is used in the form of a plate or a thick wire provided with notches for example so that its cross-sectional area is decreased.

Although a fine wire or an extra fine wire of Al, an alloy of Al, Cu or an alloy of Cu may be used as a fuse conductor, such a fuse conductor is not readily melted by an overcurrent.

SUMMARY OF THE INVENTION

An object of the present invention is to provide a conductor for use as a fuse having an excellent prearcing time/current characteristic and good drawability.

A conductor for a fuse according to the present invention contains silver of 0.5 to 20 wt.% and the balance being lead and any unavoidable impurity.

A conductor for use as a fuse according to an aspect of the invention contains silver of 0.5 to 20 wt.%, the balance being lead and at least one low melting point metal selected from the group including bismuth, indium, cadmium, antimony and tin, and any unavoidable impurity. The content of the low melting point metal is smaller than that of lead.

A conductor for use as a fuse according to another aspect of the invention contains silver of 0.5 to 20 wt.%, at least either copper or tellurium of 0.05 to 1 wt.%, and the balance being lead and any unavoidable impurity.

A conductor for use as a fuse according to a further aspect of the invention contains silver of 0.5 to 20 wt.%, at least either copper or tellurium of 0.05 to 1 wt.%, and the remainder being lead, at least one low melting point metal selected from the group including bismuth, indium, cadmium, antimony and tin, and any unavoidable impurity. The content of the low melting point metal is smaller than that of lead.

According to a preferred embodiment of the invention, a conductor for use as a fuse is a conductor wire having an inner diameter in the range from 0.05 to 0.3 mm. A conductor for a fuse according to the present invention is preferably used a fuse contained in a capacitor.

An alloy of lead and silver has an improved tensile strength compared to that of lead alone. The liquidus temperature of this alloy is not so high compared with the melting point of lead. However, if the content of silver becomes too large, the liquidus temperature of the alloy increases and the alloy is not suited for a conductor fuse. Therefore, it is necessary to limit the content of silver within a given range. In addition, it was found by the inventors of the present invention that this alloy has an excellent pre-arcing time/current characteristic. Therefore, it is desirable to use as a fuse conductor, a fine wire of an alloy of lead and silver utilizing those characteristics.

A very small amount of copper or tellurium is added to the conductor mainly composed of the lead-silver alloy in order to improve a tensile strength of the conductor, which is drawn to a fine wire.

Accordingly, a conductor for use as a fuse according to a further example of the present invention contains silver of 0.5 to 20 wt.%, at least either copper or tellurium of 0.05 to 1 wt.%, and the balance being lead and any unavoidable impurity. Further, a conductor for a fuse according to a further example of the present invention contains at least one of the above mentioned low melting point metals in the lead-silver-copper and/or tellurium alloy. The content of the low melting point metal or metals is smaller than that of lead.

If the content of silver is less than 0.5 wt.%, it contributes little to improving the tensile strength required for a fuse conductor. It is difficult to draw a fine wire of the above alloy containing silver of less than 0.5 wt.%. On the other hand, if the content of silver exceeds 20 wt.%, the temperature for generating an entire liquid phase in that composition becomes high and exceeds a melting point temperature suitable for a fuse conductor and, in addition, the alloy becomes expensive.

If the content of copper is less than 0.05 wt.%, it contributes little to improving the tensile strength. If the content of copper exceeds 1 wt.%, the temperature for generating an entire liquid phase in that composition becomes too high and exceeds a melting point temperature suitable for a fuse conductor.

The reason for limiting the content of tellurium within the range of 0.05 to 1.0 wt.% is that the content of less than 0.05 wt.% contributes little to improving the tensile strength as in the case of copper and that the content of more than 1.0 wt.% does not contribute much to improving of the tensile strength. Copper and tellurium in the above described respective ranges are added simultaneously so that the tensile strength can be further improved.

If one or more low melting point metals other than lead are contained in the alloy composition according to the present invention, and if the content of such low melting point metals becomes larger than that of lead, the drawability will be reduced. The contents of the low melting point metals are preferably in the ranges indicated below so as to ensure a good drawability and an excellent pre-arcing time/current characteristic.

Bi: 0.01 to 20 wt.%
In: 0.01 to 30 wt.%
Cd: 0.01 to 20 wt.%
Sb: 0.01 to 15 wt.%
Sn: 0.01 to 40 wt.%

In addition, by changing the contents of those low melting point metals in the above indicated ranges, it becomes possible to control a melting point temperature of the fuse conductor according to the purposes for which it is used.

The reason for limiting the preferable range of the diameter of the fuse conductor to 0.05 to 0.3 mm (50 to 300 μm) is that a diameter of more than 0.3 mm causes an increase in the current value necessary for melting the fuse conductor and makes it difficult to make a compact circuit component such as a capacitor where the fuse conductor is incorporated into the component. A diameter of less than 0.05 mm makes it difficult to fabricate wires of such a diameter in an industrial production process. Even if a wire of less than 0.05 mm can be fabricated, it will be difficult to handle a fuse conductor having a diameter of the less than 0.05 mm in cases of incorporating the fuse in a circuit component such as a capacitor, for example.

As described above, a fuse conductor according to the present invention has an excellent pre-arcing time/-current characteristic and a good drawability. In addition, since it can be drawn to a fine wire or an extra fine wire, it can be effectively utilized in various fields where a high resistance value is required for the conductor and it needs to be a fine wire or an extra fine wire. Particularly, a fuse conductor according to the present invention is effectively utilized in cases, for example, where a fusing function is to be added to the proper functions of a semiconductor device (such as an IC or a transistor) or a circuit component (such as a capacitor). Particularly, a conductor for use as a fuse according to the present invention is effectively used in a tantalum chip capacitor which will burn out if circuit components are incorporated erroneously. In such a case, it is not required to provide a device having a circuit breaker function incorporated in an electronic circuit separately from a semiconductor device or a circuit component as in the prior art. Therefore, the number of components to be incorporated can be reduced and an electronic apparatus with high reliability can be manufactured.

The foregoing and other objects, features, aspects and advantages of the present invention will become more apparent from the following detailed description of the present invention.

DESCRIPTION OF THE PREFERRED EMBODIMENTS

Embodiment 1

Alloys or pure metals having the compositions shown in Table 1 were cast each in a mold having a square cross section 20 mm by 20 mm using a melting cast method. Billets thus obtained were subjected to forging and drawing processes, whereby alloy wires or pure metal wires of various diameters as shown in Table 1 were formed.

A predetermined current was caused to flow in the so formed alloy wires or pure metal wires, so that the pre-arcing time/current characteristics thereof were examined. In this case, the pre-arcing time/current characteristics were evaluated based on minimum current values necessary for melting within one second. Accordingly, it is understood that the lower is the minimum current value necessary for melting, the better is the pre-arcing time/current characteristic. In this test for the pre-arcing time/current characteristics, each of the alloy wires or the pure metal wires was electrically connected in a given circuit with the distance between electrodes being 35 mm.

The alloy wires having the compositions of the examples No. 1 to 13 according to the present invention were easily drawn as wires having diameters of 50 to 300 μm and the minimum current values necessary for melting within one second in those examples were in the range from 0.3 to 2 A. For comparison, pre-arcing time/current characteristics of conventional examples using Al were examined in the same manner. In this examination, an Al wire having a diameter of 130 μm was melted within one second when a current of 4 A was caused to flow therethrough. From the above mentioned results, it is understood that the fuse conductors containing alloys of a low melting point metal and silver according to the present invention have much better pre-arcing time/current characteristics than the comparing examples.

In addition, as shown in Table 1, as for the alloy wires or the pure metal wires of the compositions of the examples No. 15 to 18, namely, the alloy wires or the pure lead wires with the contents of silver being more than or less than the limit values, and the alloy wires with the content of bismuth being more than the upper limit value of the preferred range, continuous wires of diameters of less than 300 μm could not be obtained or a large fusing current was required for melting within one second even if a continuous wire was obtained. Further, the diameter of the alloy wire of the conventional example No. 14 was larger than the upper limit value of the preferred range and a large circuit breaker current was required for melting within one second.

TABLE 1

| | No. | Composition (wt. %) Ag | Pb | Bi | In | Cd | Sb | Sn | Diameter (μm) | Circuit Breaker Current (A) |
|---|---|---|---|---|---|---|---|---|---|---|
| Examples of the Invention | 1 | 0.5 | rest | — | — | — | — | — | 300 | 2 |
| | 2 | 3 | rest | — | — | — | — | — | 100 | 0.8 |
| | 3 | 5 | rest | — | — | — | — | — | 100 | 0.7 |
| | 4 | 7 | rest | — | — | — | — | — | 127 | 0.9 |
| | 5 | 10 | rest | — | — | — | — | — | 150 | 1.2 |
| | 6 | 15 | rest | — | — | — | — | — | 70 | 0.4 |
| | 7 | 20 | rest | — | — | — | — | — | 50 | 0.3 |
| | 8 | 10 | rest | 5 | — | — | — | — | 100 | 0.7 |
| | 9 | 5 | rest | — | 10 | — | — | — | 150 | 1.5 |

TABLE 1-continued

| | No. | Composition (wt. %) Ag | Pb | Bi | In | Cd | Sb | Sn | Diameter (μm) | Circuit Breaker Current (A) |
|---|---|---|---|---|---|---|---|---|---|---|
| | 10 | 5 | rest | — | — | — | — | 35 | 150 | 1.7 |
| | 11 | 7 | rest | — | — | 18 | — | — | 127 | 1.0 |
| | 12 | 3 | rest | — | — | — | 2 | — | 127 | 1.1 |
| | 13 | 5 | rest | 5 | — | — | — | 5 | 100 | 1.1 |
| Examples | 14 | 5 | rest | — | — | — | — | — | 500 | 10 |
| for Comparison | 15 | 0.005 | rest | — | — | — | — | — | difficult to draw | * |
| | 16 | 60 | rest | — | — | — | — | — | 300 | 5 |
| | 17 | 0 | whole | — | — | — | — | — | difficult to draw | * |
| | 18 | 3 | rest | 60 | — | — | — | — | difficult to draw | * |

*Measurement could not be made because of difficulty in drawing.

Embodiment 2

The alloy of Pb-5 wt.% Ag having the composition of the example No. 3 shown in Table 1, which was obtained according to the Embodiment 1, was used and a wire was drawn to have a diameter 130 μm in the same manner as in the Embodiment 1. A capacitor having a circuit breaker function using the alloy wire thus obtained, was prepared. In this embodiment, the alloy wire having the diameter 130 μm used as a fuse conductor had the following characteristics: a tensile load of 58 g, an electric resistance value of 18 Ω/m, and a circuit breaker current (a minimum current necessary for melting within one second) of 3.5 A.

When a current five times larger than a rated current value was caused to flow in the capacitor containing the above described fuse conductor, only the conductor was blown and no damage was caused to the electric circuit.

Embodiment 3

Alloys or pure metals having the compositions shown in Table 2 were cast each in a mold having a square cross section 20 mm by 20 mm by using a melting cast method. The billets thus obtained were subjected to forging and drawing processes so that alloy wires or pure metal wires of various diameters as shown in Table 2 were formed.

A predetermined current was caused to flow in the alloy wires or pure metal wires thus prepared so that the pre-arcing time/current characteristics thereof were examined. The pre-arcing time/current characteristics were evaluated based on minimum current values required for melting within one second. Accordingly, it is understood that the lower the minimum current value required for melting, the better is the pre-arcing time/current characteristic. In this test for the pre-arcing time/current characteristics, each of the alloy wires or the pure metal wires was electrically connected in a predetermined circuit with the distance between electrodes being 35 mm.

The alloy wires having the compositions of the examples No. 19 to 31 according to the present invention were easily drawn to have diameters of 50 to 300 μm and the minimum current values required for melting within one second in those wires were in the range from 0.3 to 2 A. For comparison, pre-arcing time/current characteristics of Al wires as conventional examples were examined. An Al wire having a diameter of 130 μm was melted in one second when a current of 4 A was caused to flow therethrough. From the above results, it is understood that the fuse conductors containing the low melting point metals and the alloy of silver and copper and/or tellurium have much better pre-arcing time/current characteristics.

In addition, as shown in Table 2, continuous wires of diameters of less than 300 μm could not be obtained as for the alloy wires or pure metal wires having the compositions of the examples No. 33 to No. 36 for comparison, namely, the alloy wires having a silver content more than or less than the limit values, the pure metal wire of lead, and the alloy wires having the contents of bismuth exceeding the upper limit value in the preferred range. Further, the alloy wire of the example No. 32 for comparison had the diameter exceeding the upper limit value of the preferred range and a larger fusing current was required for melting within one second.

TABLE 2

| | No. | Composition (wt. %) Ag | Cu | Te | Pb | Bi | In | Cd | Sb | Sn | Diameter (μm) | Tensile Strength (kg/mm²) | Circuit Breaker Current (A) |
|---|---|---|---|---|---|---|---|---|---|---|---|---|---|
| Examples | 19 | 0.5 | 0.08 | — | rest | — | — | — | — | — | 300 | 2.5 | 2 |
| of the | 20 | 5 | 0.05 | 0.05 | rest | — | — | — | — | — | 100 | 5.7 | 0.8 |
| Invention | 21 | 7 | — | 0.1 | rest | — | — | — | — | — | 100 | 4.2 | 0.7 |
| | 22 | 10 | 0.05 | 0.05 | rest | — | — | — | — | — | 127 | 5.8 | 0.9 |
| | 23 | 20 | 0.50 | 0.50 | rest | — | — | — | — | — | 100 | 6.7 | 0.7 |
| | 24 | 20 | 0.15 | 0.15 | rest | — | — | — | — | — | 50 | 6.5 | 0.3 |
| | 25 | 5 | 0.15 | 0.10 | rest | — | — | — | — | — | 100 | 4.6 | 0.8 |
| | 26 | 10 | 0.15 | 0.15 | rest | 5 | — | — | — | — | 150 | 4.2 | 1.2 |
| | 27 | 5 | 0.10 | 0.10 | rest | — | — | — | — | 5 | 127 | 3.8 | 1.0 |
| | 28 | 5 | 0.25 | 0.25 | rest | — | 10 | — | — | — | 127 | 4.3 | 1.4 |
| | 29 | 10 | 0.10 | 0.20 | rest | — | — | 18 | — | — | 127 | 5.0 | 1.0 |
| | 30 | 10 | 0.20 | 0.20 | rest | — | — | — | 2 | — | 100 | 5.5 | 0.7 |
| | 31 | 15 | 0.30 | 0.30 | rest | 1 | — | — | 2 | — | 100 | 5.0 | 0.7 |
| Examples | 32 | 5 | 0.05 | 0.05 | rest | — | — | — | — | — | 500 | 3.6 | 10 |
| for | 33 | 0.005 | — | — | rest | — | — | — | — | — | difficult to draw | * | * |
| Comparison | 34 | 30 | 2 | 2 | rest | — | — | — | — | — | difficult | * | * |

TABLE 2-continued

| No. | Composition (wt. %) Ag | Cu | Te | Pb | Bi | In | Cd | Sb | Sn | Diameter (μm) | Tensile Strength (kg/mm²) | Circuit Breaker Current (A) |
|---|---|---|---|---|---|---|---|---|---|---|---|---|
| 35 | 0 | 0 | 0 | whole | — | — | — | — | — | to draw difficult | * | * |
| 36 | 3 | 0.10 | 0.10 | rest | 60 | — | — | — | — | to draw difficult to draw | * | * |

*Measurement could not be made because of difficulty in drawing.

Embodiment 4

An alloy of Pb-20 wt.% Ag-0.15 wt.% Cu-0.15 wt.% Cu-0.15 wt.% Te of the composition No. 24 shown in Table 2, obtained according to the Embodiment 1 was used and a wire was drawn to have a diameter of 100 μm in the same manner as in Embodiment 3. A capacitor having a circuit breaker function using the alloy wire thus obtained was prepared. The above mentioned alloy wire having the diameter of 100 μm was used as a fuse conductor having the following characteristics: a tensile strength of 48 g, an electric resistance value of 21 Ω/m, and a circuit breaker current, minimum current necessary for melting within one second, of 1.0 A.

When a current five times larger than the rated current value was made to flow in the capacitor having the above described fuse conductor, only the conductor was blown and no damage was caused to the other electric circuit.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An integrated circuit component, comprising a fuse conductor wire having a diameter within the range of 0.05 to 0.3 mm, said fuse conductor wire being made of an alloy consisting of 3 to 20% by weight of silver the balance being lead and any unavoidable impurity, said alloy enabling drawing said fuse conductor wire down to said diameter range of 0.05 to 0.3 mm for assuring a circuit breaker current suitable for protecting said integrated circuit component.

2. An integrated circuit component, comprising a fuse conductor wire having a diameter within the range of 0.05 to 0.3 mm, said fuse conductor wire being made of an alloy consisting of 3 to 20% by weight of silver, the balance being lead and at least one low melting point metal selected from the group consisting of bismuth, indium, cadmium antimony, and tin, wherein a content of said low melting point metal is smaller than that of said lead, and any unavoidable impurity, said alloy enabling drawing said fuse conductor wire down to said diameter range of 0.05 to 0.3 mm for assuring a circuit breaker current suitable for protecting said integrated circuit component.

3. An integrated circuit component, comprising a fuse conductor wire having a diameter within the range of 0.05 to 0.3 mm, said fuse conductor wire being made of an alloy consisting of 3-to 20% by weight of silver forming a first alloy component, a second alloy component selected from the group consisting of copper and tellurium 0.05 to 1.0% by weight, the balance being lead and any unavoidable impurity, said alloy enabling drawing said fuse conductor wire down to said diameter range of 0.05 to 0.3 mm for assuring a circuit breaker current suitable for protecting said integrated circuit component.

4. An integrated circuit component, comprising a fuse conductor wire having a diameter within the range of 0.05 to 0.3 mm, said fuse conductor wire being made of an alloy consisting of 3 to 20% by weight of silver forming a first alloy component, a second alloy component selected from the group consisting of copper and tellurium 0.05 to 1.0% by weight, a third alloy component forming the balance being lead and at least one low melting point metal selected from the group consisting of bismuth, indium, cadmium, antimony, and tin, and any unavoidable impurity, wherein the content of said at least one low melting point metal is smaller than that of said lead, said alloy enabling drawing said fuse conductor wire down to said diameter range of 0.05 to 0.3 mm for assuring a circuit breaker current suitable for protecting said integrated circuit component.

* * * * *